US006393639B1

(12) United States Patent
Ohsner

(10) Patent No.: US 6,393,639 B1
(45) Date of Patent: May 28, 2002

(54) INFLATABLE BABY CUSHIONING APPARATUS

(76) Inventor: Aida L. Ohsner, 1005 W. Duarte Rd., Arcadia, CA (US) 91007

( * ) Notice: Subject to any disclaimer, the term of this patent is extended or adjusted under 35 U.S.C. 154(b) by 0 days.

(21) Appl. No.: 09/671,900

(22) Filed: Sep. 28, 2000

(51) Int. Cl.[7] ..... A47G 9/06; A47C 21/08; A47C 27/18

(52) U.S. Cl. ..... 5/425; 5/424; 5/427; 5/655; 5/655.3; 5/945

(58) Field of Search ..... 5/424, 425, 427, 5/417, 420, 655, 655.3, 945

(56) References Cited

U.S. PATENT DOCUMENTS

| | | | | | |
|---|---|---|---|---|---|
| 1,738,411 | A | * | 12/1929 | Welch | 5/655 |
| 2,629,884 | A | * | 3/1953 | McMonagle | 5/655 |
| 2,644,173 | A | * | 7/1953 | James | 5/425 |
| 3,761,975 | A | | 10/1973 | Personett | |
| 4,607,402 | A | * | 8/1986 | Pollard | 5/425 |
| 4,712,258 | A | * | 12/1987 | Eves | 5/655 X |
| 4,754,509 | A | * | 7/1988 | Pollard | 5/425 |
| 4,788,726 | A | * | 12/1988 | Rafalko | 5/425 X |
| 4,873,734 | A | * | 10/1989 | Pollard | 5/425 |
| 4,964,858 | A | | 10/1990 | Livny | |
| 5,035,013 | A | * | 7/1991 | Bloom | 5/420 |
| 5,088,139 | A | * | 2/1992 | Bloom | 5/420 |
| 5,103,514 | A | | 4/1992 | Leach | |
| D330,139 | S | * | 10/1992 | Bloom | 5/655 X |
| 5,351,348 | A | * | 10/1994 | Beger | 5/420 |
| D353,494 | S | | 12/1994 | Beger | |
| D357,589 | S | * | 4/1995 | Langhammer et al. | 5/945 X |
| 5,455,973 | A | * | 10/1995 | Brumfield et al. | 5/424 |
| 5,551,108 | A | | 9/1996 | Butler, III | |
| 5,813,066 | A | * | 9/1998 | Gebhard et al. | 5/655 |
| 5,852,838 | A | | 12/1998 | Johnson | |
| D416,159 | S | * | 11/1999 | Porter | 5/655 X |
| 6,163,905 | A | * | 12/2000 | Noldus-Nilsen | 5/655.3 |

FOREIGN PATENT DOCUMENTS

| | | | | |
|---|---|---|---|---|
| DE | 4024807 A1 | * | 2/1992 | 5/655 |
| FR | 2585228 | * | 1/1987 | 5/427 |
| GB | 868320 | * | 5/1961 | 5/427 |
| GB | 2113990 A | * | 1/1983 | 5/655.3 |

* cited by examiner

*Primary Examiner*—Robert G. Santos

(57) ABSTRACT

An inflatable baby cushioning apparatus for restricting the movement of infants. The inflatable baby cushioning apparatus includes an inflatable baby cushioning apparatus comprising a pad. The pad includes a peripheral edge and a plurality of tubular members. Each of the plurality of tubular members includes a pair of ends and a peripheral wall extending therebetween.

13 Claims, 4 Drawing Sheets

INFLATABLE BABY CUSHIONING APPARATUS

BACKGROUND OF THE INVENTION

1. Field of the Invention

The present invention relates to cushions and more particularly pertains to a new inflatable baby cushioning apparatus for restricting the movement of infants.

2. Description of the Prior Art

The use of cushions is known in the prior art. More specifically, cushions heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,761,975; U.S. Pat. No. 4,964,858; U.S. Pat. No. 5,103,514; U.S. Pat. No. 5,551,108; U.S. Pat. No. 5,852,838; and U.S. Pat. No. Des. 353,494.

While these devices fulfill their respective, particular objectives and requirements, the aforementioned patents do not disclose a new inflatable baby cushioning apparatus. The inventive device includes an inflatable baby cushioning apparatus comprising a pad. The pad includes a peripheral edge and a plurality of tubular members. Each of the plurality of tubular members includes a pair of ends and a peripheral wall extending therebetween.

In these respects, the inflatable baby cushioning apparatus according to the present invention substantially departs from the conventional concepts and designs of the prior art, and in so doing provides an apparatus primarily developed for the purpose of restricting the movement of infants.

SUMMARY OF THE INVENTION

In view of the foregoing disadvantages inherent in the known types of cushions now present in the prior art, the present invention provides a new inflatable baby cushioning apparatus construction wherein the same can be utilized for restricting the movement of infants.

The general purpose of the present invention, which will be described subsequently in greater detail, is to provide a new inflatable baby cushioning apparatus apparatus and method which has many of the advantages of the cushions mentioned heretofore and many novel features that result in a new inflatable baby cushioning apparatus which is not anticipated, rendered obvious, suggested, or even implied by any of the prior art cushions, either alone or in any combination thereof.

To attain this, the present invention generally comprises an inflatable baby cushioning apparatus comprising a pad. The pad includes a peripheral edge and a plurality of tubular members. Each of the plurality of tubular members includes a pair of ends and a peripheral wall extending therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inflatable baby cushioning apparatus apparatus and method which has many of the advantages of the cushions mentioned heretofore and many novel features that result in a new inflatable baby cushioning apparatus which is not anticipated, rendered obvious, suggested, or even implied by any of the prior art cushions, either alone or in any combination thereof.

It is another object of the present invention to provide a new inflatable baby cushioning apparatus which may be easily and efficiently manufactured and marketed.

It is a further object of the present invention to provide a new inflatable baby cushioning apparatus which is of a durable and reliable construction.

An even further object of the present invention is to provide a new inflatable baby cushioning apparatus which is susceptible of a low cost of manufacture with regard to both materials and labor, and which accordingly is then susceptible of low prices of sale to the consuming public, thereby making such inflatable baby cushioning apparatus economically available to the buying public.

Still yet another object of the present invention is to provide a new inflatable baby cushioning apparatus which provides in the apparatuses and methods of the prior art some of the advantages thereof, while simultaneously overcoming some of the disadvantages normally associated therewith.

Still another object of the present invention is to provide a new inflatable baby cushioning apparatus for restricting the movement of infants.

Yet another object of the present invention is to provide a new inflatable baby cushioning apparatus which includes an inflatable baby cushioning apparatus comprising a pad. The pad includes a peripheral edge and a plurality of tubular members. Each of the plurality of tubular members includes a pair of ends and a peripheral wall extending therebetween.

Still yet another object of the present invention is to provide a new inflatable baby cushioning apparatus that allows a user a clean and comfortable changing area on which to place their baby.

Even still another object of the present invention is to provide a new inflatable baby cushioning apparatus that is very portable allowing a user to fold it up and take it to change their baby's diapers in a wide variety of locations.

An even further object of the present invention is to provide a new inflatable baby cushioning apparatus that protects the surface under the invention from being soiled by changing the baby.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
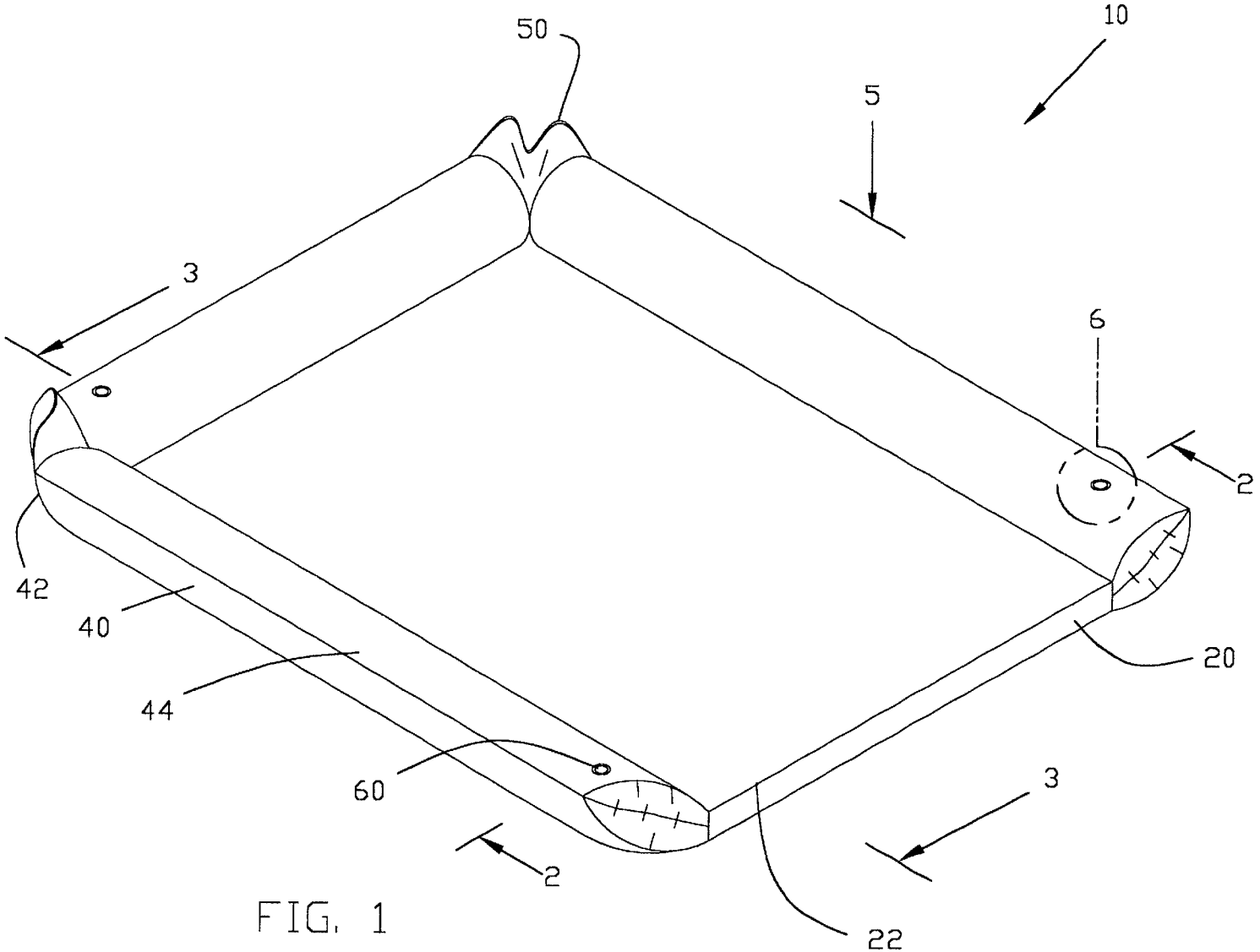
FIG. 1 is a schematic perspective view of a new inflatable baby cushioning apparatus according to the present invention.
Figure 2:
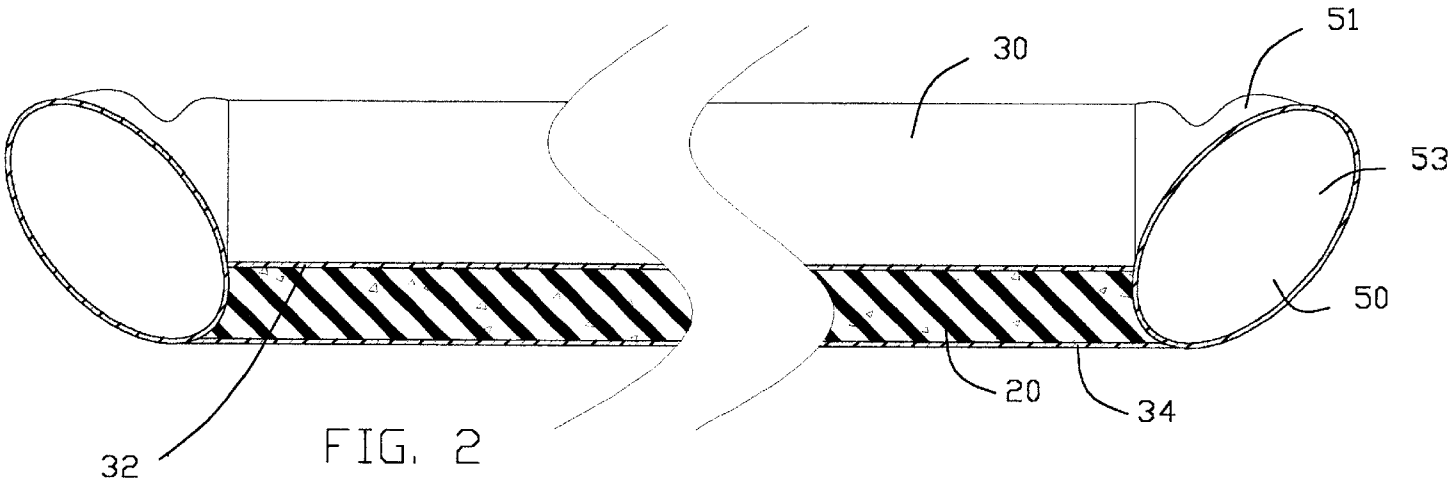
FIG. 2 is a schematic cross-sectional view of the present invention along line 2—2.
Figure 3:
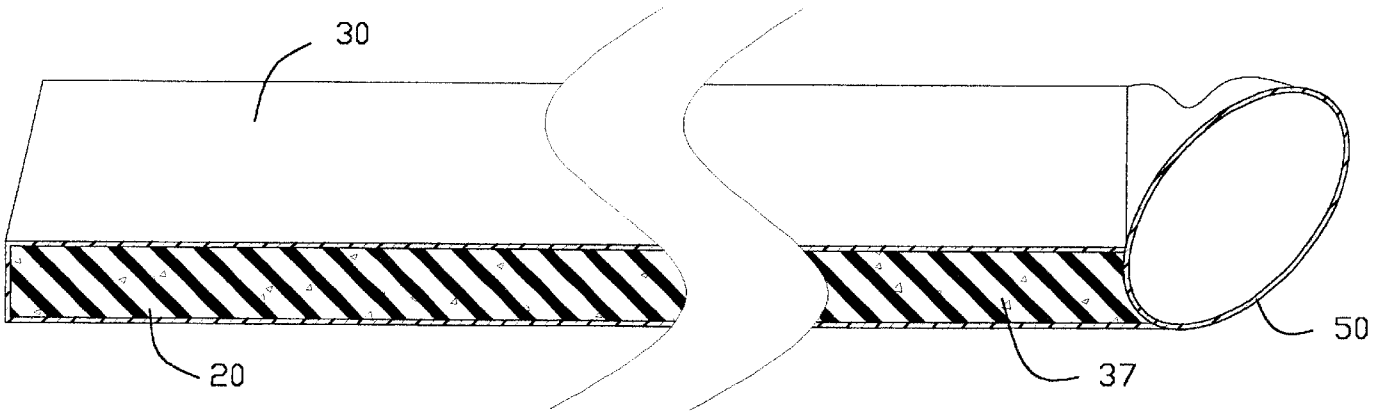
FIG. 3 is a schematic cross-sectional view of the present invention along line 3—3.
Figure 5:
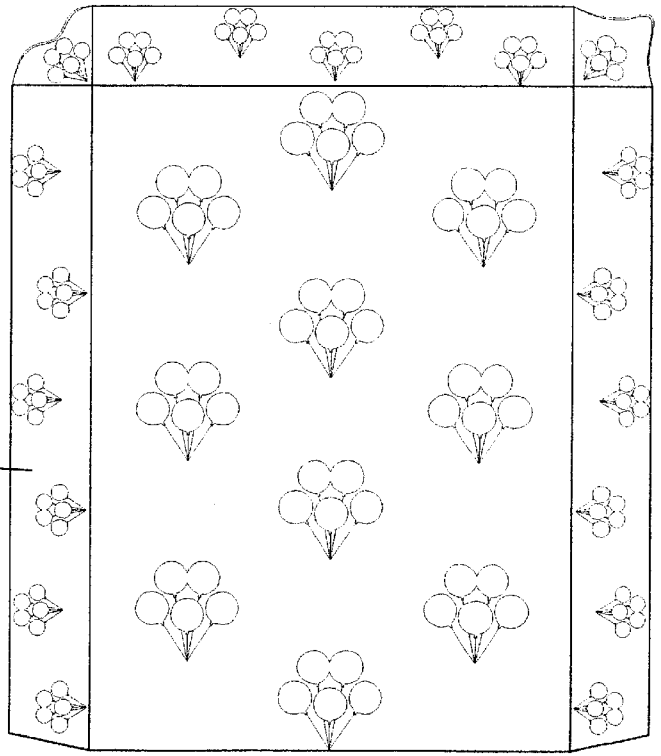
FIG. 5 is a schematic top view of the present invention showing a decorative pattern of the covering.
Figure 4:
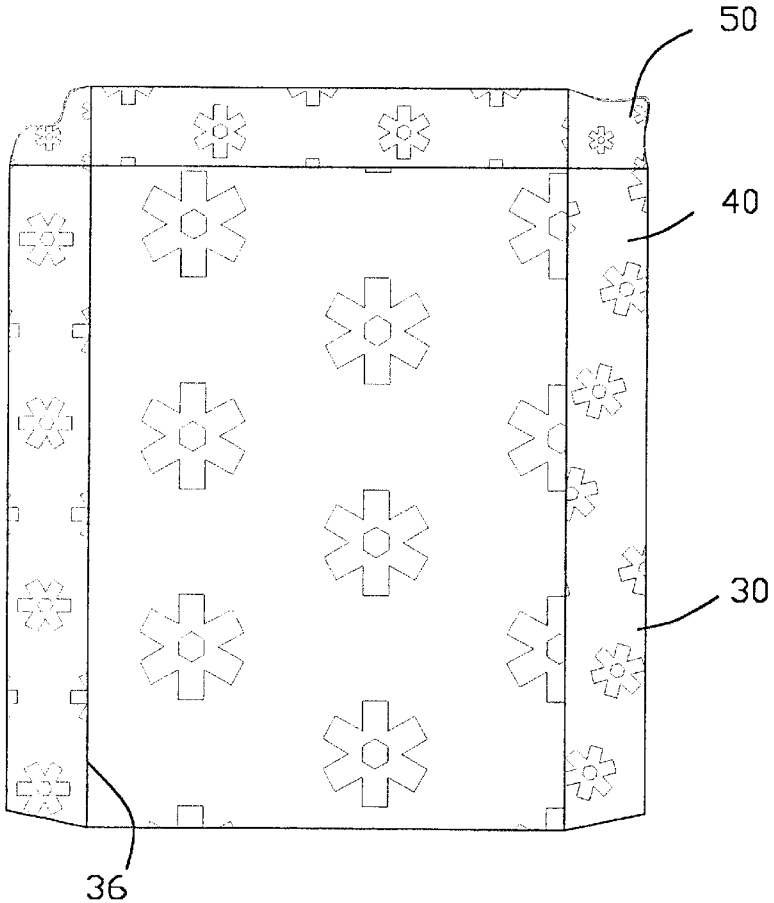
FIG. 4 is a schematic top view of the present invention showing a decorative pattern of the covering.
Figure 6:
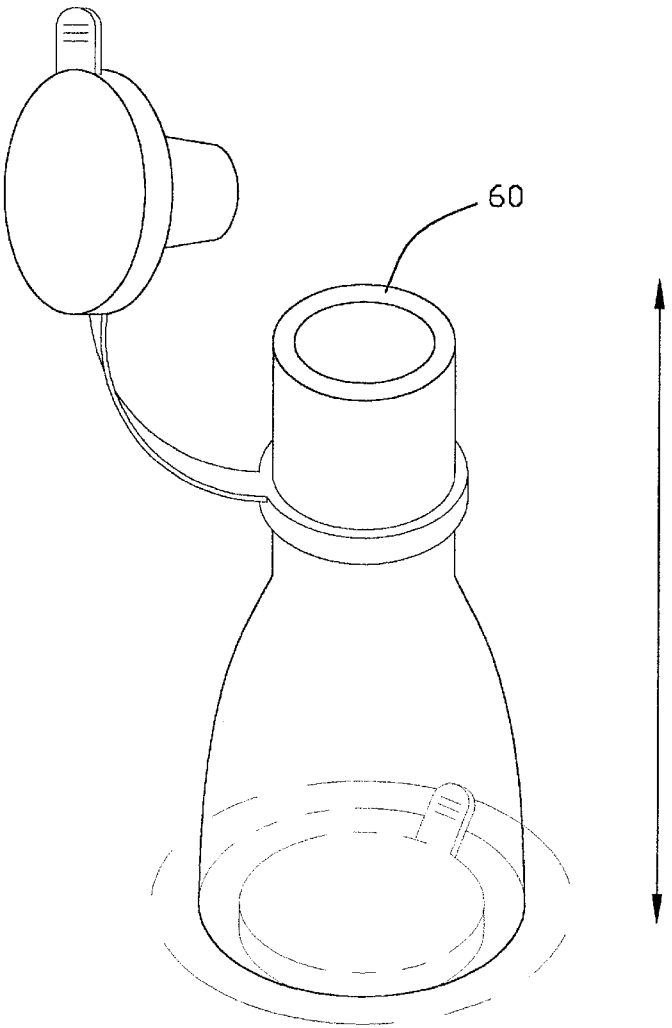
FIG. 6 is a schematic perspective view of the present invention showing the inflation valve.

With reference now to the drawings, and in particular to FIGS. 1 through 6 thereof, a new inflatable baby cushioning apparatus embodying the principles and concepts of the present invention and generally designated by the reference numeral 10 will be described.

As best illustrated in FIGS. 1 through 6, the inflatable baby cushioning apparatus 10 generally comprises an inflatable baby cushioning apparatus comprising a pad 20. The pad 20 generally includes a rectangular shape. However, a variety of other shapes may be used. The pad includes a peripheral edge 22 and is comprised of a generally rigid material. The pad 20 generally includes a covering 30. The covering 30 includes a first panel 32 and a second panel 34. The panels 32 & 34 include four side edges 36. The four side edges 36 of the panels are securably coupled together to form a chamber 37. In an embodiment the pad 20 is positioned in the chamber 37 of the covering 30. The covering 30 is generally comprised of a resiliently flexible material. For example, the covering may be comprised of cloth or vinyl. Additionally, the covering 30 may have a variety of patterns, such as balloons, horses or snowflakes. The pad 20 also generally includes a plurality of tubular members 40. Each of the plurality of tubular members 40 includes a pair of ends 42 and a peripheral wall 44 extending therebetween. Each of the tubular members 40 are securably coupled to one of three edges 36 of the covering 30 such that the tubular members 40 are each coupled to the covering 30 along their length. Each of the tubular members 40 includes a length generally equal to the side edge 36 of the covering 30. Each of the tubular members 40 is substantially hollow. However, each of the tubular members 40 may also be composed of a solid material such as foam or cotton. Each of the tubular members 40 is comprised of a resiliently flexible material. The inflatable baby cushioning apparatus 10 also includes a pair of coupling members 50. Each of the coupling members 50 is relatively thin and includes a front side 51 and a back side 53. Each of the front sides 51 is securely coupled to a pair of respectively adjacent tubular member ends 42 and extending upwardly therefrom. Each of the coupling members 50 is comprised of a resiliently flexible material. Each of the plurality of tubular members 40 includes a plurality of valve means 60 for inflating the tubular members. Each of the valve means 60 is integrally coupled to and extending into one of the tubular members 40. Each of the valve means 60 is selectively positioned between an open and a closed position.

In use, the inflatable baby cushioning apparatus provides a user the ability to place their baby down on almost any surface. To begin to use the present invention, a user inflates the plurality of tubular members. Once the plurality of tubular members are inflated, a user may place their baby on the pad.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inflatable baby cushioning apparatus comprising:

a pad, said pad having a peripheral edge; and a plurality of tubular members, each of said tubular members having a pair of ends and a peripheral wall extending therebetween, each of said tubular members being attached to said pad along a portion of said peripheral edge;

wherein said pad comprises an upper wall and a lower wall with a resiliently compressible material positioned therebetween, each of said upper and lower walls having a perimeter edge extending generally along the peripheral edge of said pad, a portion of the perimeter edges of each of said upper and lower walls being mounted on said plurality of tubular members, said lower wall having a relatively greater area and said upper wall having a relatively lesser area relative to each other such that said tubular members are biased into a position toward said upper wall and away from said lower wall.

2. The inflatable baby cushioning apparatus of claim 1, wherein said pad comprises a foamed elastomeric material.

3. The inflatable baby cushioning apparatus of claim 1, wherein each of said tubular members is substantially hollow.

4. The inflatable baby cushioning apparatus of claim 1, wherein the perimeter edge of said pad is substantially rectangular and said upper and lower walls of said pad each have a length and a width, wherein the length of said lower wall is greater than the length of said upper wall and the width of said lower wall is greater than the length of said upper wall.

5. An inflatable baby cushioning apparatus comprising:

a pad, said pad having a peripheral edge;

a covering, said covering having a peripheral edge; and a plurality of tubular members, each of said tubular members having a pair of ends and a peripheral wall extending therebetween, each of said tubular members being attached to said pad along a portion of said peripheral edge;

wherein said pad comprises an upper wall and a lower wall with a resiliently compressible material positioned therebetween, each of said upper and lower walls having a perimeter edge extending generally along the peripheral edge of said pad, a portion of the perimeter edges of each of said upper and lower walls being mounted on said plurality of tubular members, said lower wall having a relatively greater area and said upper wall having a relatively lesser area relative to each other such that said tubular members are biased into a position toward said upper wall and away from said lower wall.

6. The inflatable baby cushioning apparatus of claim 5, wherein said covering has a first panel and a second panel, said panels having a peripheral edge, said peripheral edges of said panels being coupled together to form a chamber, wherein said pad is positioned in said chamber of said covering.

7. The inflatable baby cushioning apparatus of claim 6, wherein said covering comprises a resiliently flexible material.

8. The inflatable baby cushioning apparatus of claim 5, wherein each of said tubular members is coupled to said covering along their length, each of said tubular members having a length generally equal to a side edge of said covering.

9. The inflatable baby cushioning apparatus of claim 8, wherein each of said tubular members is substantially hollow.

10. The inflatable baby cushioning apparatus of claims 5, further comprising:

a pair of coupling members, each of said coupling members being relatively thin and having a front side and a back side, each of said front sides being coupled to a pair of respectively adjacent tubular member ends and extending upwardly therefrom.

11. The inflatable baby cushioning apparatus of claim 10, wherein each of said coupling members comprises of a resiliently flexible material.

12. The inflatable baby cushioning apparatus of claim 5, further comprising:

a plurality of valves for inflating said tubular members, each of said valve means being integrally coupled to and extending into one of said tubular members, each of said valves being selectively positioned between an open and closed position.

13. An inflatable baby cushioning apparatus comprising:

a pad having a peripheral edge;

a covering having a peripheral edge; and a plurality of tubular members, each of said tubular members having a pair of ends and a peripheral wall extending therebetween, each of said tubular members being attached to said pad along a portion of said peripheral edge;

wherein said pad comprises an upper wall and a lower wall with a resiliently compressible material positioned therebetween, each of said upper and lower walls having a perimeter edge extending generally along the peripheral edge of said pad, a portion of the perimeter edges of each of said upper and lower walls being mounted on said plurality of tubular members, said lower wall having a relatively greater area and said upper wall having a relatively lesser area relative to each other such that said tubular members are biased into a position toward said upper wall and away from said lower wall;

wherein said covering has a first panel and a second panel, said panels having a peripheral edge, said peripheral edges of said panels being coupled together to form a chamber, wherein said pad is positioned in said chamber of said covering;

wherein said covering comprises a resiliently flexible material;

wherein each of said tubular members is coupled to said covering along their length, each of said tubular members having a length generally equal to a side edge of said covering;

a pair of coupling members, each of said coupling members being relatively thin and having a front side and a back side, each of said front sides being coupled to a pair of respectively adjacent tubular member ends and extending upwardly therefrom, each of said coupling members comprising a resiliently flexible material;

wherein the perimeter edge of said pad is substantially rectangular and said upper and lower walls of said pad each have a length and a width, wherein the length of said lower wall is greater than the length of said upper wall and the width of said lower wall is greater than the length of said upper wall.

* * * * *